US007342176B2

(12) United States Patent
Takeda

(10) Patent No.: US 7,342,176 B2
(45) Date of Patent: Mar. 11, 2008

(54) METHOD FOR JOINING CORE MEMBER AND GRIPPER IN POLYMER INSULATOR, AND POLYMER INSULATOR

(75) Inventor: Takayuki Takeda, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 11/260,114

(22) Filed: Oct. 28, 2005

(65) Prior Publication Data

US 2006/0060375 A1 Mar. 23, 2006

Related U.S. Application Data

(62) Division of application No. 10/370,097, filed on Feb. 21, 2003, now abandoned.

(30) Foreign Application Priority Data

Feb. 25, 2002 (JP) ..... 2002-047551

(51) Int. Cl.
*H01B 17/00* (2006.01)

(52) U.S. Cl. ..... 174/138 F; 174/196; 174/74 A; 174/174; 174/77 R; 174/82

(58) Field of Classification Search ..... 174/196, 174/74 A, 174, 77 R, 82, 138 F
See application file for complete search history.

(56) References Cited

U.S. PATENT DOCUMENTS

| | | | | |
|---|---|---|---|---|
| 4,001,128 A | | 1/1977 | Penneck | |
| 4,212,696 A | * | 7/1980 | Lusk et al. | 156/294 |
| 4,435,615 A | | 3/1984 | Kaczerginski et al. | |
| 4,505,033 A | | 3/1985 | Wheeler | |
| 4,740,539 A | | 4/1988 | Goel | |
| 4,749,824 A | | 6/1988 | Orbeck | |
| 4,845,318 A | | 7/1989 | Clabburn et al. | |
| 5,539,155 A | * | 7/1996 | Kunieda et al. | 174/188 |

FOREIGN PATENT DOCUMENTS

| | | | |
|---|---|---|---|
| CN | 1098549 | | 2/1995 |
| CN | 2298710 | | 9/2000 |
| JP | S40-020299 | | 9/1940 |
| JP | S46-005678 | | 12/1971 |
| JP | S-56-078145 | | 6/1981 |
| JP | 03033074 A | * | 2/1991 |
| JP | H05-002319 | | 1/1993 |
| JP | 06-236716 | | 8/1994 |
| JP | 08-36928 | | 2/1996 |

OTHER PUBLICATIONS

English abstract of JP03033074A.*

* cited by examiner

*Primary Examiner*—Jinhee Lee
(74) *Attorney, Agent, or Firm*—Steptoe & Johnson LLP

(57) ABSTRACT

A method for joining a core member and grippers in a polymer insulator including a core member, an outer sheath comprised of a body and caps, which are provided around the core member, and the grippers provided on both ends of the core member, comprising (a) providing the core member with a filler on the outer circumferential surface thereof or the grippers with a filler on the inner circumferential surface thereof, (b) inserting the core member into the grippers, and (c) clinching the grippers to fasten the grippers and the core member.

3 Claims, 2 Drawing Sheets

METHOD FOR JOINING CORE MEMBER AND GRIPPER IN POLYMER INSULATOR, AND POLYMER INSULATOR

This application is a divisional of application Ser. No. 10/370,097 filed Feb. 21, 2003 now abandoned.

BACKGROUND OF THE INVENTION

1. Field of the Invention

The present invention relates to a method for joining a core member and grippers in a polymer insulator including a core member, an outer sheath comprised of a body and caps, which are provided around the core member, and the grippers provided on both ends of the core member. Moreover, the present invention relates to the polymer insulator.

2. Description of the Related Art

Heretofore, a polymer insulator has been known, which include a core member, an outer sheath comprised of a body and caps, which are provided around the core member, and grippers provided on both ends of the core member. Moreover, in the polymer insulator, the joining of the core member and the grippers has been performed in such a manner that, for example, using divided dice, the respective dice being pushed toward the center of the core member with equal strengths to one another, and thus the grippers are clinched to the core member. As described above, the grippers are clinched (attached by pressure), and thus tensile strengths of joint portions of the core member and the grippers are maintained.

Conventional polymer insulators have been able to meet various properties conventionally required therefor. However, the demand to improve the tensile strengths of the joint portions of the grippers and the core member has increased in recent years. If the tensile strengths of the joint portions can be improved, then sufficient tensile strengths can be obtained even if the overall length of the grippers is shortened. It is thus made possible to shorten the clinch and grip length of the grippers, and to reduce the weight of the grippers and the cost due to the reduction of the number of clinching, and further to improve the performance of the polymer insulators. However, a technique capable of effectively improving the tensile strength between the joint portions of the grippers and the core member has not been discovered yet.

SUMMARY OF THE INVENTION

The first feature of the present invention is a method for joining a core member and grippers in a polymer insulator including a core member an outer sheath comprised of a body and caps, which are provided around the core member, and the grippers provided on both ends of the core member, characterized in that any of (1) a filler, (2) an adhesive and (3) an adhesive containing the filler is interposed in joint interfaces between the core member and the grippers when the grippers are clinched and joined to the core member.

Moreover, the second feature of the present invention is a polymer insulator including a core member, an outer sheath comprised of a body and caps, which are provided around the core member, the grippers provided on both ends of the core member, and joint assistance layers in joint interfaces between the core member and the grippers, the joint assistance layers being comprised of any of (1) a filler, (2) an adhesive and (3) an adhesive containing the filler.

DETAILED DESCRIPTION OF EMBODIMENTS

Figure 1:
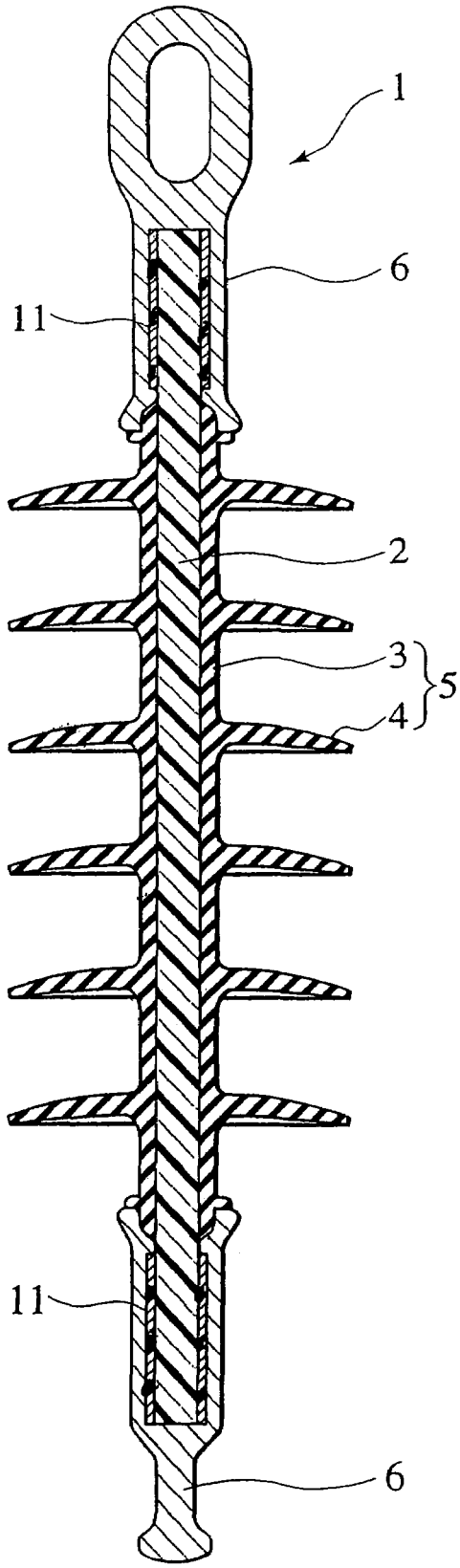
FIG. 1 is a view showing a configuration of one embodiment of a polymer insulator of the present invention.

As shown in FIG. 1, the polymer insulator 1 is comprised of the FRP core 2 as a core member, the outer sheath 5 comprised of the body 3 and the caps 4, which are provided on the outer circumference of the FRP core 2, the grippers 6 provided on both ends of the FRP core 2, and the joint assistance layers 11 provided on joint interfaces between the FRP core 2 and the grippers 6. The joint assistance layers 11 are comprised of any of (1) a filler, (2) an adhesive and (3) an adhesive containing the filler. The joint assistance layer 11 that is a feature of the present invention will be described below in detail.

Figure 2A:
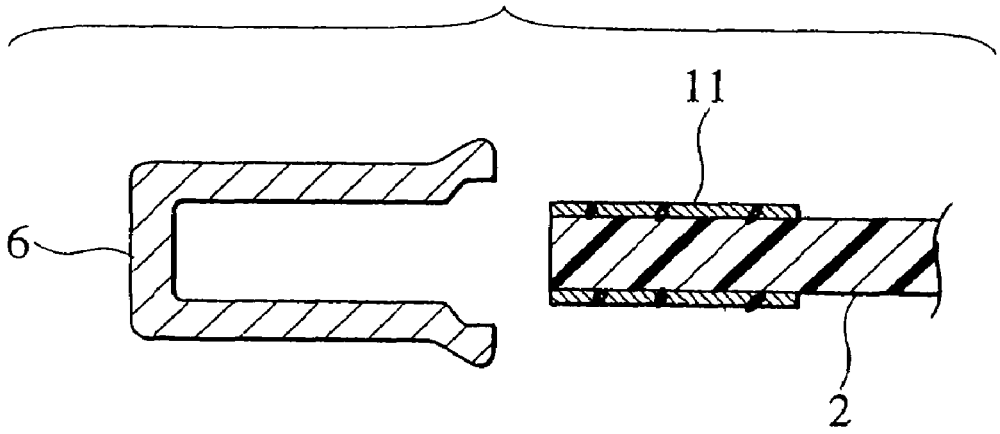
FIGS. 2A to 2C are views for explaining one embodiment of a method for joining a core member and a gripper in the polymer insulator of the present invention.
Figure 2B:
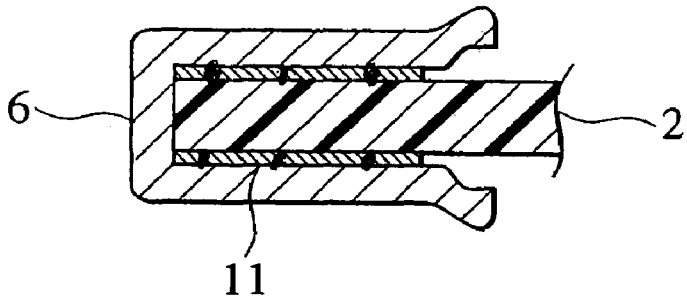
Figure 2C:
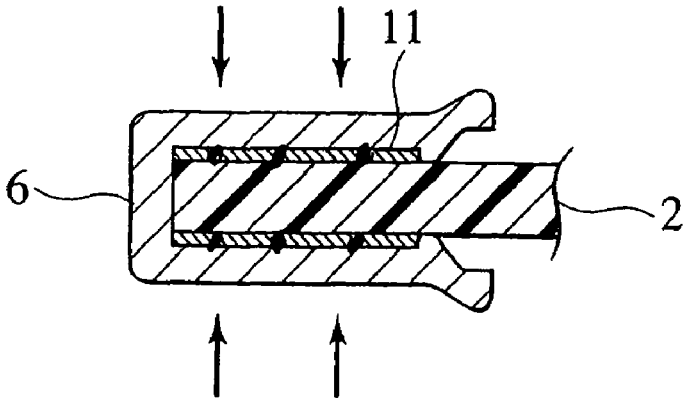

FIG. 2A illustrates a state before the core member 2 provided with the joint assistance layer 11 on the outer circumference thereof is inserted into the gripper 6. FIG. 2B illustrates a state before tightening the gripper 6 after the core member 2 provided with the joint assistance layer 11 on the outer circumference thereof is inserted into the gripper 6. FIG. 2C illustrates a state after the gripper 6 is tightened. Note that, though only one end of the polymer insulator 1 is illustrated in the example shown in FIGS. 2A to 2C, the joining can be performed in the other end similarly. Moreover, for the purpose of simplifying the drawings, only a portion of the gripper 6 in the vicinity of the joint assistance layer 11 is shown, and the upper and lower end portions of the gripper 6, which are shown in FIG. 1, are omitted.

First, as shown in FIG. 2A, the gripper 6 and the FRP core 2 are prepared. On an end portion of the FRP core 2, the joint assistance layer 11 is provided on the entire outer circumference of the portion in contact with the gripper 6.

As the joint assistance layer 11, any of (1) a filler, (2) an adhesive and (3) an adhesive containing the filler is used. As types of the filler for use, silica, calcium carbonate and aluminum hydroxide are given. As types of the adhesive for use, an epoxy adhesive, a vinyl adhesive, a cyanoacryl adhesive and an ester adhesive are given.

Here, as the filler, it is preferable to use silica having a particle diameter ranging from 10 to 500 μm. Moreover, as the adhesive, it is preferable to use the epoxy adhesive. Furthermore, in the case of using the adhesive containing the filler, it is preferable to mix a filler of 40 to 120 parts by weight with an adhesive of 125 parts by weight.

In the above-described embodiment, the joint assistance layer 11 is provided on the entire outer circumference of the end portion of the FRP core 2. However, the joint assistance layer 11 can be provided also on the bottom portion of the FRP core 2. Furthermore, the joint assistance layer 11 can be provided also on the entire portion of the inner circumferential surface of the gripper 6 in contact with the FRP core 2. Moreover, though the outer sheath 5 is not formed on the outer circumference of the FRP core 2 in the above-described embodiment, the outer sheath 5 can also be formed on the outer circumference of the FRP core 2.

Next, as shown in FIG. 2B, the end portion of the FRP core 2, which has been provided with the joint assistance layer 11, is inserted into the gripper 6. Thereafter, as shown in FIG. 2C, the portion of the gripper 6 is pushed from the outside thereof by, for example, using divided dice equal strengths in directions shown by arrows toward the center of the FRP core 2. In this case, the FRP core 2 has been set inside the portion of the gripper 6 with the joint assistance layer 11 interposed therebetween. In such a manner, the gripper 6 is fastened to the FRP core 2. Thus, the FRP core 2 and the gripper 6 are joined together with the joint assistance layer 11 interposed therebetween.

The above-described method for joining a core member and grippers in a polymer insulator according to the present invention can acquire an effect thereof when the same method is applied to any polymer insulators. Particularly, the application effect of the present invention to a distribution polymer insulator of a relatively small dimension with, for example, a withstand voltage of 6.6 kV, is high because it is difficult to improve the tensile strength of the joint portion thereof by other means.

One example of the present invention will be described below.

First, the polymer insulator 1 in a shape shown in FIG. 1 was prepared, which included the gripper 6 comprised of ductile cast-iron and having an outer diameter of 27 mm and an inner diameter of 17.3 mm, and included the FRP core 2 having an outer diameter of 16.5 mm. As polymer insulators 1 of the example, polymer insulators of Examples 1 to 5 were prepared. Example 1 was a polymer insulator in which only the epoxy adhesive was interposed in the joint interfaces between the grippers 6 and the FRP core 2. Examples 2 to 4 were polymer insulators in which the epoxy adhesives containing the fillers comprised of silica, each having a particle diameter ranging from 10 to 500 μm, were interposed therein. Here, mixture ratios of the fillers with the adhesives were as shown in Tables 1 and 2. Example 5 was a polymer insulator in which only the filler comprised of silica having a particle diameter ranging from 10 to 500 μm was interposed therein.

Moreover, as a polymer insulator of a comparative example, a polymer insulator of Comparative example 1 was prepared, in which the grippers 6 were only clinched and nothing was interposed in the joint interfaces between the grippers 6 and the FRP core 2.

With regard to a method for clinching the grippers 6 to the FRP core 2, one clinching operation was performed at eight spots in a grip length of 30 mm on each gripper 6 in the circumferential direction. Clinch pressures were set at 300 kgf/cm$^2$ and 350 kgf/cm$^2$.

Tensile strengths were measured and fracture behaviors were investigated for the polymer insulators of Examples and Comparative example. Table 1 shows results of the examples to which the clinch pressure of 300 kgf/cm$^2$ was applied, and Table 2 shows the results of the examples to which the clinch pressure of 350 kgf/cm$^2$ was applied.

TABLE 1

| | | Mixture ratio * | Tensile strength (kN) | Fracture behavior |
|---|---|---|---|---|
| Comparative example 1 | | only clinched | 45 | FRP is fallen |
| Examples of the Invention | 1 | 0 only adhesive | 67 | FRP is fallen |
| | 2 | 40 | 92 | FRP is fallen |
| | 3 | 80 | 100 | FRP is fallen |
| | 4 | 120 | 102 | gripper is broken |
| | 5 | only filler | 74 | FRP is fallen |

* Mixture ratio: parts by weight of filler with respect to adhesive of 125 parts by weight

TABLE 2

| | | Mixture ratio * | Tensile strength (kN) | Fracture behavior |
|---|---|---|---|---|
| Comparative example 1 | | only clinched | 52 | FRP is fallen |
| Examples of the Invention | 1 | 0 only adhesive | 80 | FRP is fallen |
| | 2 | 40 | 105 | gripper is broken |
| | 3 | 80 | 107 | gripper is broken |
| | 4 | 120 | 80 | FRP is broken |
| | 5 | only filler | 75 | FRP is fallen |

* Mixture ratio: parts by weight of filler with respect to adhesive of 125 parts by weight As described above, in the polymer insulator of Example 1, only the adhesive was interposed in the joint interfaces between the grippers 6 and the FRP core 2. In the polymer insulators of Examples 2 to 4, the adhesives containing the fillers were interposed therein. In the polymer insulator of Example 5, only the filler was interposed therein. As shown in Tables 1 and 2, it is understood that the polymer insulators of Examples 1 to 5 can achieve higher tensile strengths compared to the polymer insulator of Comparative example 1. Moreover, by comparing the polymer insulators of Examples 1 and 5 with the polymer insulators of Examples 2 to 4, it is understood that, preferably, the adhesive containing the filler is interposed in the joint interface. It is further understood that, preferably, with regard to the mixture ratio of the filler with the adhesive, filler of 40 to 120 parts by weight is mixed with adhesive of 125 parts by weight.

As apparent from the above description, in comparison with the polymer insulator of the related art, in which the grippers have been joined to the core member by the clinching, the polymer insulator of the present invention, in which any of (1) the filler, (2) the adhesive and (3) the adhesive containing the filler is interposed in the joint interfaces between the core member and the grippers, can improve the tensile strength of the joint portions of the grippers and the core members. As a result, the shortening of the clinch and grip length of the grippers, the reduction of the weight of the grippers and the reduction of the cost due to the reduction of the number of clinching times are made possible, and further, a measurable improvement in the performance of the polymer insulator can be seen.

Although the present invention has been explained with specific examples and numeral values, it is of course apparent to those skilled in the art that various changes and modifications thereof are possible without departing from the broad spirit and aspect of the present invention as defined in the appended claims.

CROSS REFERENCE TO RELATED APPLICATIONS

This application is based upon and claims the benefit of priority from prior Japanese Patent Application P2002-047551 filed on Feb. 25, 2002; the entire contents of which are incorporated by reference herein.

What is claimed is:

1. A polymer insulator comprising:

a fiber reinforced plastic (FRP) core member;

an outer sheath comprised of a body and caps, which are provided around the core member;

grippers provided on both ends of the core member; and joint assistance layers consisting of particulate filler in joint interfaces between the core member and the grippers, said particulate filler selected from the group consisting of silica, calcium carbonate, and aluminum hydroxide;

the grippers being clinched onto the core.

2. The polymer insulator according to claim 1, wherein said filler consists of silica having a particle diameter ranging from 10 to 500 μm.

3. The polymer insulator according to claim 1 wherein the particulate filler is silica.

* * * * *